United States Patent [19]

Brumen

[11] 4,389,161

[45] Jun. 21, 1983

[54] LOCKING OF ROTOR BLADES ON A ROTOR DISK

[75] Inventor: Claudio Brumen, Denver, Colo.

[73] Assignee: United Technologies Corporation, Hartford, Conn.

[21] Appl. No.: 218,241

[22] Filed: Dec. 19, 1980

[51] Int. Cl.[3] ..... F01D 5/32

[52] U.S. Cl. ..... 416/220 R

[58] Field of Search ..... 416/221, 220 R, 218; 403/316, 317, 319, 355, 356, 358, 381, 359, 323, 324, 331

[56] References Cited

U.S. PATENT DOCUMENTS

| | | | |
|---|---|---|---|
| 1,072,457 | 9/1913 | Herr | 416/221 |
| 1,303,090 | 5/1919 | McCray | 403/331 |
| 2,713,991 | 7/1955 | Secord et al. | 416/221 |
| 2,755,062 | 7/1956 | Hill | 416/221 |
| 2,994,507 | 8/1961 | Keller et al. | 416/221 |
| 3,807,898 | 4/1974 | Guy et al. | 416/220 R |

FOREIGN PATENT DOCUMENTS

| | | | |
|---|---|---|---|
| 1128113 | 1/1957 | France | 416/221 |
| 948722 | 2/1964 | United Kingdom . | |

*Primary Examiner*—Louis J. Casaregola
*Assistant Examiner*—Jeffrey A. Simenauer
*Attorney, Agent, or Firm*—Gene D. Fleischhauer

[57] ABSTRACT

A rotor stage assembly 20 of the type adapted for use in an axial flow gas turbine engine is disclosed. The assembly includes a rotor disk 36, at least two rotor blades 42 and a scalloped lock pin 52. The scalloped lock pin has lugs 54. The disk is adapted by a groove 40 and each blade is adapted by a groove 48 to receive the scalloped lock pin. During assembly the scalloped lock pin is alignable with blade attachment slots 44 in the disk to enable insertion of the blades and is slidable in the grooves 40, 48 to bring each lug 54 on the scalloped pin into engagement with a corresponding groove in a rotor blade.

3 Claims, 4 Drawing Figures

LOCKING OF ROTOR BLADES ON A ROTOR DISK

DESCRIPTION

1. Technical Field

This invention relates to axial flow rotary machines and more particularly to the use of a single locking device to retain a plurality of rotor blades on a rotor disk.

The concepts were developed in the gas turbine engine industry for locking compressor and turbine blades to the rotors of such engines, but have wider applicability to similarly configured assemblies.

2. Background Art

In the gas turbine engine field, rotor assemblies are typically formed of axially adjacent rotor disks from which pluralities of blades extend radially across the path of working medium gases flowing through the engine. An example of such a bladed rotor stage assembly is shown in U.S. Pat. No. 3,807,898 entitled "Bladed Rotor Assemblies" issued to Guy et al. In this assembly, a plurality of sealing plates extend from the rotor disk to each rotor blade platform to lock the blades in place in the fore and aft direction and to block leakage between the platforms and the disk. Another locking device is illustrated in U.S. Pat. No. 2,713,991 entitled "Rotor Blade Locking Device" issued to Secord et al. In this construction, the locking device is a circumferentially extending cylinder. The rotor blade has an L-shaped lip which engages the cylinder such that the cylinder presents two shearing planes in the wire to resist movement of the blade in a generally axial direction. These shearing planes are transversely oriented to the longitudinal axis of the cylinder.

Notwithstanding the availability of the above locking devices, scientists and engineers continue to seek improved locking devices which are light in weight and which block the leakage of working medium gases between the rotor blade and the rotor disk.

DISCLOSURE OF THE INVENTION

According to the present invention, at least two rotor blades of a rotor assembly are retained in a rotor disk in the fore and aft direction by a scalloped pin which is both alignable during assembly with slots in the disk to permit insertion of the rotor blades into the disk slots and subsequently slidable into engagement with the rotor blades and the disk to trap the blades on the disk.

According to one specific embodiment of the present invention, the scalloped pin is slidable along a groove in the disk to bring lugs on the scalloped pin into engagement with correspondingly aligned grooves in each of the rotor blades.

A primary feature of the present invention is a rotor disk adapted by blade attachment slots to receive rotor blades. The rotor disk has a groove in the periphery of the disk. Each rotor blade has a groove which faces the groove in the disk. Another feature is a scalloped lock pin. The pin has lugs each of which engages a corresponding rotor blade. The pin extends in a lateral direction across the disk and the root of the blade. In one embodiment a radial projection on the rotor blade bounds the groove in the rotor blade. The scalloped lock pin is slidable along the grooves in the blade and the disk during assembly. In one embodiment, the scalloped lock pin is disposed in the groove in the disk, aligned with the slots in the disk to enable insertion of at least two rotor blades, and is slidable into engagement with the rotor blades and the disk to trap the blades on the disk.

A primary advantage of the present invention is the small size of the blade lock which is enabled by resisting fore and aft movement of the rotor blade along a circumferential shear section through the lock as compared with blade locks resisting movement of the blade along shear planes extending in a transverse direction. Another advantage is the engine efficiency which results from blocking the leakage of working medium gases across the rotor disk between the root of the rotor blade and the disk with the scalloped lock pin. Another advantage is the low level of blade root stresses, which is attributable to the lateral engagement of the blade root at the blade/disk interface. The ease of assembly is enhanced by retaining the blade against movement in the fore and aft direction with a lock pin which is completely accessible from one side of the disk. The ease of assembly is further enhanced by enabling all lock pins to be disposed within a disk groove before insertion of the rotor blades and by enabling movement of the lock pin in the groove during and after installation of the rotor blades.

The foregoing and other objects, features and advantages of the present invention will become more apparent in the light of the following detailed description of the preferred embodiment thereof as shown in the accompanying drawing.

BEST MODE FOR CARRYING OUT THE INVENTION

Figure 1:
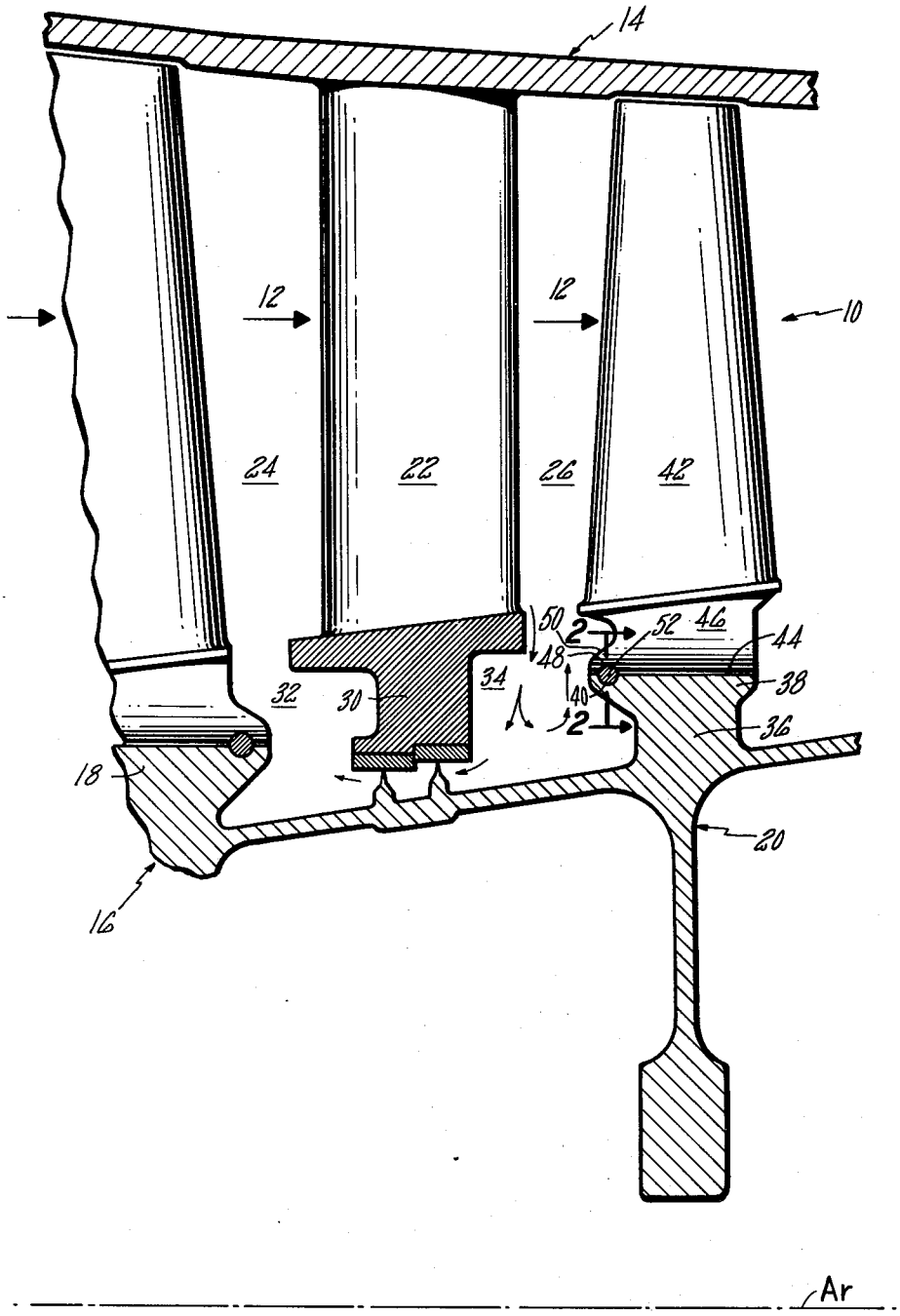
FIG. 1 is a cross-sectional view of a portion of a compressor section of a gas turbine engine employing the concepts of the present invention.

The concepts of the present invention are illustrated in the compressor of a gas turbine engine. FIG. 1 shows a portion of a compressor 10. A flow path 12 for working medium gases extends axially through the compressor. The compressor includes a stator assembly 14 and a rotor assembly 16. The rotor assembly has an axis of rotation Ar and includes an upstream rotor stage 18 and a downstream rotor stage 20. The downstream rotor stage is spaced axially from the upstream rotor stage leaving between these stages both an axial portion of the flow path and a cavity inwardly of the flow path. The stator assembly includes an array of stator vanes 22 extending across the flow path which divide the axial portion of the flow path into an upstream region 24 having a first pressure and a downstream region 26 having a pressure higher than the first pressure. A shroud 30 engages the tip region of each vane and extends circumferentially to divide the cavity between the rotor stages into an upstream cavity 32 and a downstream cavity 34. The upstream cavity is in fluid communication with the downstream cavity.

The downstream rotor stage 20 includes a disk 36 having a periphery such as the rim section 38 which extends circumferentially about the disk. The periphery of the rotor disk has a groove 40 extending in a generally circumferential (lateral) direction and facing in a generally outward direction. The rotor assembly includes a plurality of rotor blades such as the single rotor blade 42 extending outwardly across the working medium flow path. The rim section 38 is adapted to receive the rotor blades by a plurality of blade attachment slots as represented by the single blade attachment slot 44. These slots extend in a generally axial direction. Each rotor blade has a root 46 which is adapted to conform to a corresponding blade attachment slot. The root has a groove 48. The groove 48 in the root is oriented to face the groove in the disk when the blade is in the installed condition. In the installed condition, the groove in the root is in axial and radial alignment with the groove in the disk. A radial projection 50 on the root extends both axially and radially to bound the groove in the blade and is adjacent to the working medium gases in the high pressure downstream cavity 34. A scalloped lock pin 52 extending both in the disk groove and in a corresponding blade groove engages the disk and the blade.

Figure 2:
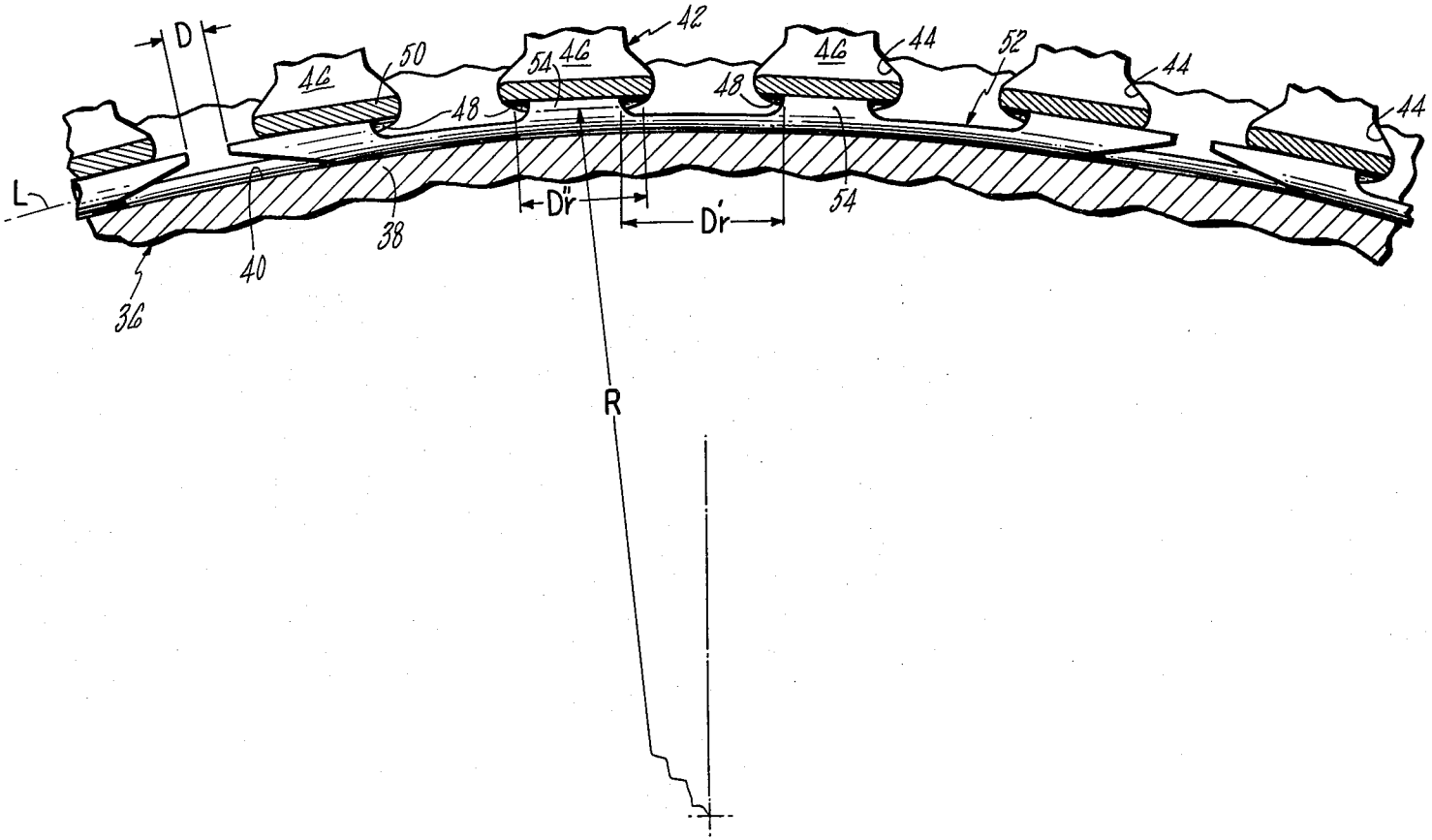
FIG. 2 is a sectional view along the lines 2—2 of FIG. 1.

FIG. 2 is an enlarged sectional view taken along the lines 2—2 of FIG. 1 and shows two scalloped lock pins 52 spaced a distance D one from the other. Each pin has a longitudinal axis L. The pin has a slight curvature and extends laterally in the circumferential groove 40 of the disk 36. The pin has radial lugs 54. Each radial lug extends into a corresponding groove 48 in a rotor blade 42. The lugs on each pin are spaced circumferentially one from another leaving a circumferential distance Dr′ therebetween at a radius R from the center of the disk. The blade attachment slot has a circumferential width Dr″ at the radius R from the center of the disk. The distance Dr′ is greater than or equal to the distance Dr″ ($Dr' \geqq Dr''$).

Figure 3:
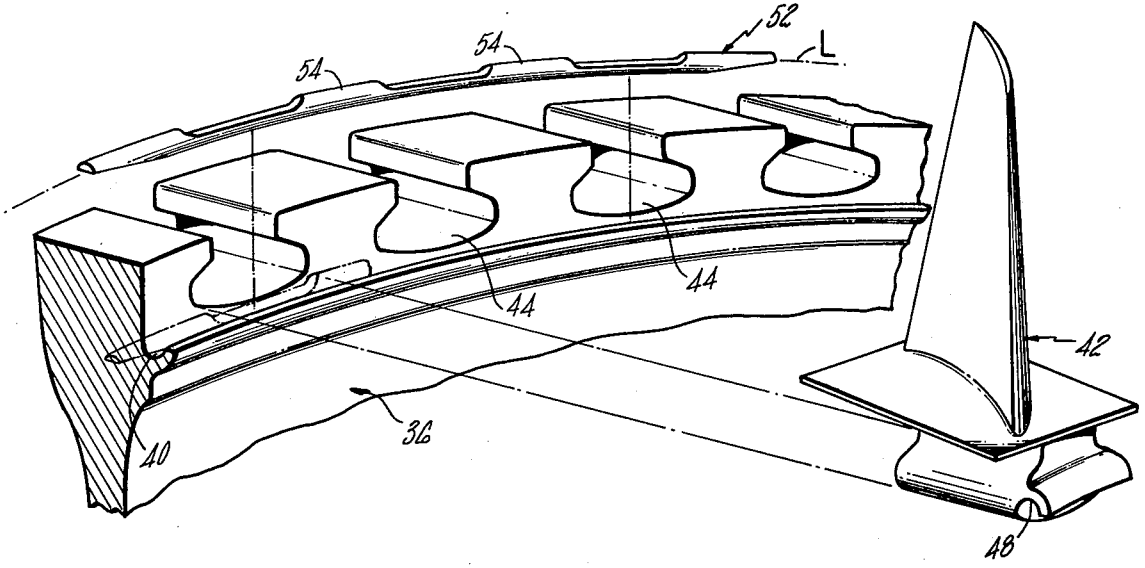
FIG. 3 is an exploded partial perspective view of a rotor stage assembly of FIG. 1.

FIG. 3 is an exploded partial perspective view of a rotor disk 36, a rotor blade 42 and a scalloped lock pin 52. In this particular embodiment the circumferential distance Dr′ between the radial lugs 54 on each pin is greater than the circumferential width Dr″ of the blade attachment slot. The phantom lines show the scalloped lock pin disposed in the groove 40 of the disk and aligned with the disk to enable assembly of the rotor blades 42.

Figure 4:
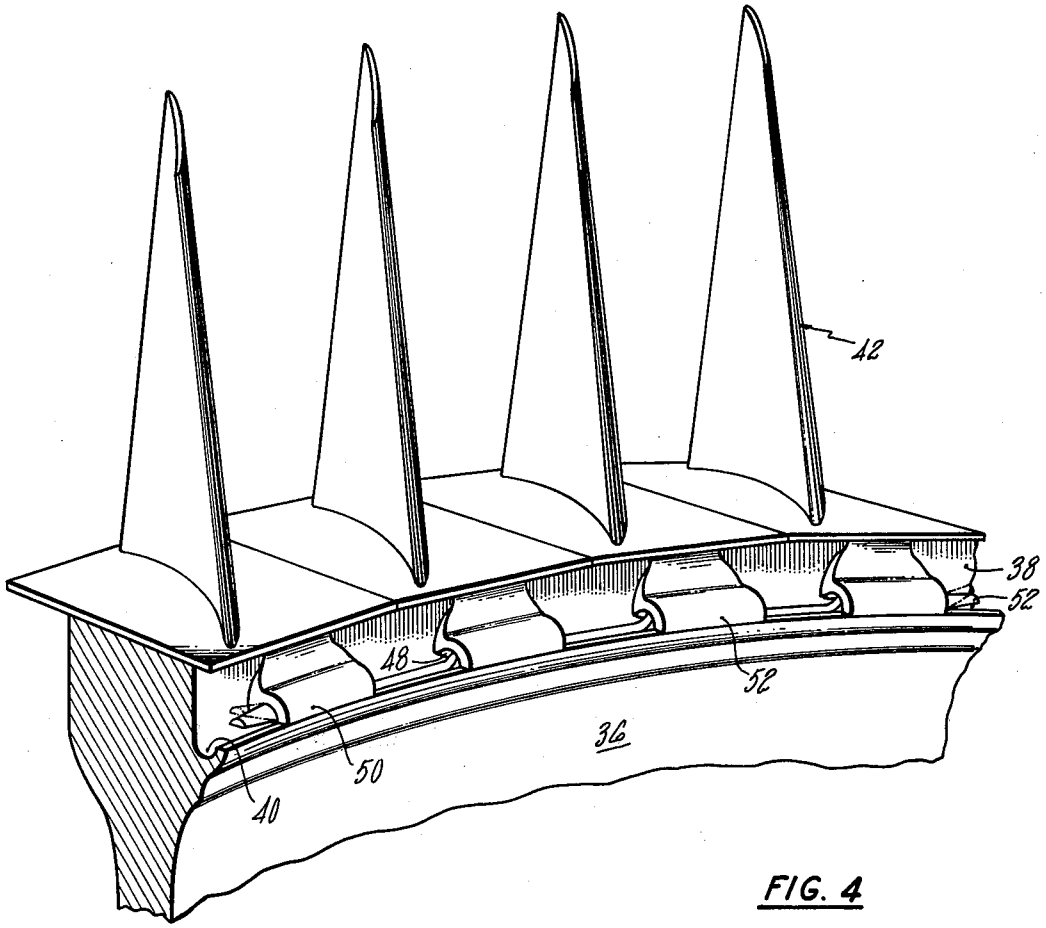
FIG. 4 is a partial perspective view of the rotor stage assembly of FIG. 3 in the assembled condition.

FIG. 4 is a partial perspective view of the rotor disk 36, the rotor blade 42 and the scalloped lock pin 52 in the assembled condition.

During assembly, the scalloped lock pin 52 and the array of rotor blades 42 are installed in the rim 38 of the rotor disk 36. As shown by the phantom lines of FIG. 3, the scalloped pin is first aligned in the disk with the slots 44 in the disk to enable insertion of the corresponding rotor blades in a generally axial direction. In this position, the radial lugs on the scalloped lock pin are aligned with corresponding portions of the disk extending between the blade attachment slots. As the blades are inserted into the disk, each blade passes by the adjacent lugs and engages a corresponding blade attachment slot 44 in the disk. The scalloped pin is slidable into engagement with the rotor blades and the disk to trap the blades on the disk. As shown in FIG. 2 and FIG. 4 this engagement is accomplished by sliding the scalloped lock pin along the groove 40 in the disk to bring the lugs of the scalloped pin into engagement with the correspondingly aligned grooves 48 in each of the rotor blades. The scalloped lock pin is slidable circumferentially along the groove 40 in the disk and the grooves 48 in the blades to aid in the installation and alignment of other lock pins as additional blades are installed in the disk. Because of this slidable feature and the orientation of the disk groove, the adjacent pins may be installed in abutting contact. In such a case, the distance D between adjacent lock pins is zero.

As shown in FIG. 4, the lock pin is secured against circumferential movement by bending each end of the pin in the radial direction, preferably outwardly. As will be realized, other mechanical means securing the pin may be employed. In addition, the pins may be secured in place by welding or brazing.

During operation of the gas turbine engine, working medium gases are flowed through the compressor 10 along the flow path 12. As the gases pass through the compressor along the flow path, the gases tend to recirculate from the high pressure cavity 34 through the knife edge seals on the circumferentially extending shroud 30 to the low pressure cavity 32. This recirculating flow decreases the efficiency of the compressor. The radial projections 50 on the base of each rotor blade cause pumping of the working medium gases in a direction opposite to circulation of the recirculating flow, reducing the recirculating flow and decreasing the loss in compressor efficiency.

As the gases are pumped axially along flow path 12 through the rotor stage 20 of the compressor, the gases exert a force either in the upstream (fore) direction during normal operation or in the downstream (aft) direction such as might occur during surge. The scalloped lock pin 52 engages both the blade and the disk such that movement of the blade in both the fore and aft direction is resisted by the shearing strength of the pin acting along a longitudinally oriented shear section such as a longitudinal plane or a circumferential section in the pin. The pin 52 presents a larger shear area to shearing forces than do pins which resist fore and aft movement of the blade with a shearing force developed in the pin along a plane perpendicular to the circumferential section. A smaller diameter pin 52 may be used to retain the blade against a given force as compared with these transverse shear pins reducing the weight of the assembly and aerodynamic losses associated with the means for retaining the pin.

Several advantages result from the specific location of the pin with respect to the disk and the blade described. The pin engages the root of the blade and the disk at the base of the blade. The blade stresses are low in this region as compared with the stresses in the blade which result from engaging the blade radially outwardly of this point where the circumferential width of the blade is smaller than the base region. Moreover, the scalloped pin acts to block the leakage of working medium gases through the blade attachment slot across the disk. In addition, the design permits accessibility of the disk groove during fabrication to allow the edges of the disk to be finished to reduce the stress concentration at the edge of the blade attachment slot.

As will be realized, the cross-sectional shape of the pin is circular as are the grooves which reduces the stress concentrations in the disk and the blade. Other cross-sectional shapes may be employed and are considered to be within the scope of this invention.

Although the invention has been shown and described with respect to preferred embodiments thereof, it should be understood by those skilled in the art that various changes and omissions in the form and detail thereof may be made therein without departing from the spirit and the scope of the invention.

I claim:

1. A method of installing rotor blades on a rotor disk comprising the steps of:

placing a scalloped lock pin having lugs in axial engagement with the periphery of the rotor disk by installing the pin in a groove which faces outwardly;

aligning the scalloped pin with slots in the disk to permit insertion of at least two rotor blades in a generally axial direction, each into a corresponding blade attachment slot in the disk;

inserting said rotor blades in the blade attachment slot such that a groove in each rotor blade is axially and radially aligned with and faces said groove in the disk;

sliding the scalloped lock pin along the groove in the disk to bring the lugs of the scalloped pin into engagement with the correspondingly aligned grooves in each of the rotor blades; and securing the lock pin against circumferential movement.

2. In an axial flow rotary machine of the type having a rotor assembly which includes a disk having slots extending in a generally axial direction, each slot adapting the disk to receive a corresponding rotor blade, the improvement which comprises:

a rotor disk having a groove extending in a generally circumferential direction and facing in a generally outward direction;

at least two rotor blades each having a root, each root having a groove extending in a generally circumferential direction, facing and in axial and radial alignment with the groove in the disk;

at least one scalloped lock pin for engaging both the rotor disk and at least two rotor blades, each lock pin extending circumferentially in the disk groove to engage the disk and having radial lugs, each lug extending radially into the corresponding groove in the root of a corresponding blade to trap the rotor blade against fore and aft movement with respect to the disk, at least one pair of adjacent lugs being spaced one from the other a sufficient distance apart to permit passage of the blades therethrough.

3. The axial flow rotary machine of claim 2 wherein each slot has a width W and wherein each lug of said scalloped lock pin is spaced from the adjacent lug of said pin by a distance greater than the width W.

* * * * *